US006937978B2

(12) United States Patent
Liu

(10) Patent No.: US 6,937,978 B2
(45) Date of Patent: Aug. 30, 2005

(54) SUPPRESSION SYSTEM OF BACKGROUND NOISE OF SPEECH SIGNALS AND THE METHOD THEREOF

(75) Inventor: Chia-Horng Liu, Taoyuan Hsien (TW)

(73) Assignee: Chungwa Telecom Co., Ltd., Taoyuan Hsien (TW)

( * ) Notice: Subject to any disclaimer, the term of this patent is extended or adjusted under 35 U.S.C. 154(b) by 558 days.

(21) Appl. No.: 09/984,544

(22) Filed: Oct. 30, 2001

(65) Prior Publication Data

US 2003/0101048 A1 May 29, 2003

(51) Int. Cl.[7] ..... G10L 21/02; G10L 11/04
(52) U.S. Cl. ..... 704/228; 704/207; 704/226
(58) Field of Search ..... 704/207, 226–228

(56) References Cited

U.S. PATENT DOCUMENTS 5,819,213 A * 10/1998 Oshikiri et al. ..... 704/222
5,864,797 A * 1/1999 Fujimoto ..... 704/223
6,104,994 A * 8/2000 Su et al. ..... 704/233
6,205,421 B1 * 3/2001 Morii ..... 704/226
6,345,248 B1 * 2/2002 Su et al. ..... 704/223
6,453,289 B1 * 9/2002 Ertem et al. ..... 704/225
6,711,538 B1 * 3/2004 Omori et al. ..... 704/223

* cited by examiner

*Primary Examiner*—Tālivaldis Ivars Šmits
*Assistant Examiner*—Matthew J Sked
(74) *Attorney, Agent, or Firm*—Rosenberg, Klein & Lee

(57) ABSTRACT

A suppression system of background noise of speech signals uses an adaptive filter of long-time and short-time statistical characteristics of the speech signals. Since the statistical characteristics of the speech signals vary with time, the associated coefficents of the filter also have to be adjusted according to the varitation of the speech signals to eliminate the unnecessary background noise. High frequency attenuation of the speech signals is compensated for by passing the signal through a high frequency booster to elevate the degree of brightness of the speech signals and to improve their quality.

11 Claims, 5 Drawing Sheets

SUPPRESSION SYSTEM OF BACKGROUND NOISE OF SPEECH SIGNALS AND THE METHOD THEREOF

BACKGROUND OF THE INVENTION

1. Field of the Invention This invention relates to a kind of suppression system of background noise of speech signals and the method thereof. The suppression system of background noise of the invention focuses on the short time and long time characteristics of speech signals and the method thereof.

2. Description of the Prior Art

Voice sound signals are a major data type transmitted in telecommunication systems. During the process of communication, in addition to the voice sounds, background noise of the telecommunication environment also enters into the telephone, and will cause some degree of interference and influences the quality of the telecommunication. In particular, recent rapidly-growing mobile phone use is easily influenced by the background noise. So the technology of suppression of background noise is one important topic relating to quality of current telecommunication systems. There are three kinds of technology commonly used for the suppression of background noise, as follows:

The first method is the method of deleting the noise in the frequency domain. The basic principle of this method is to estimate the energy of the noise within the frequency domain in a segment of non-speech sounds, and then to eliminate the estimated energy of the noise at each frequency in the frequency domain in the speech segments that follow. Although this method is simple, its effect on suppression of background noise is limited, since the statistical characteristics of the general background noise varies with time. This method of suppression of noise is disclosed in U.S. Pat. No. 6,175,602 and 5,742,927.

The second method is the method of deleting the background noise in the time domain. The basic principle of this method is utilization of two microphones to receive the outside signals. The Primary microphone is used to receive the speaker's voice along with the background noise. The secondary microphone is used to receive only the background noise. Thus, the background noise could be estimated through the secondary microphone. Next, by subtracting the estimated background noise from the signal of the first microphone in the time domain, better quality speech signals can be obtained. However, this method requires two microphones and there must be a sufficient distance between these two microphones, which is nearly impossible for mobile phone applications.

The third method is the periodic tracking method. The basic principle of this method is to estimate and track the periods of voice signals first, and next to find the average of the related signals within a few periods. The enhancement of speech is achieved by averaging the delayed and weighted versions of input speech signals, where the delay lengths correspond to the detected pitch periods. Since background noise does not possess the same pitch periods as the original speech, it is cancelled out by this operation. The concept of using subtraction with periodic tracking is disclosed in U.S. Pat. 5,598,158.

It could be found from the above mentioned methods that there still are many drawbacks in the above-mentioned technologies and there is a urgent need for improvement.

SUMMARY OF THE INVENTION

The purpose of this invention is to provide a suppression system and method of suppression of background noise in speech signals wherein it constructs the model of the speech signals by utilizing one all-pole linear prediction filter and also detects the pitch periods which only exist in the speech signals, and it reduces the background noise according to the estimated associated speech signal coefficients and the estimated speech signal pitch periods which further enhances the quality of the voice sounds signals.

Another purpose of this invention is to provide a system of suppression of background noise of speech signals and the method thereof which could largely elevate the quality of the input signals with a low signal-to-noise ratio, as well as adjust the related coefficients adaptively.

Yet another purpose of this invention is to provide a system of suppression of background noise of speech signals and the method thereof which has low degree of complexity and requires only one microphone, so that it is fairly suitable to be used with mobile phones and the technology of speech recognition, so as to enhance the quality of speech coding and the recognition rate of speech signals.

The background noise suppression system for speech signals is used to enhance the decrease in the quality speech signals caused by the influence of background noise. The analog speech signals are transformed into digital ones first through the sampling unit for further digital signal processing. The bandwidth of the voice sounds is about 4 KHz. According to the Nyquist sampling principle, the minimum required sampling frequency is 8 KHz. In order to elevate the degree of correlation between these sampling signals, the sampling frequency is increased from 8 KHz to 32 KHz, which is called "oversampling". The digital signals after sampling are represented using a 12 bit pulse Code Modulation (PCM) technology. That is to say, the allowable variation range of the digital sound samples is within ±2048.

The system and the method of suppression of background noise of speech signals of this invention comprises: one oversampling unit, two low-pass filter units, one adaptive speech analysis unit, one pitch detection unit, one background noise suppression unit, and one high-frequency booster unit. Let us assume that the speech signals containing the background noise is $S_n(t)$; first $S_n(t)$ is oversampled by the oversampling unit with a sampling rate that is much higher than the Nyquist rate to increase the correlation between speech samples. Next, we represent the digit signals $S_n(k)$ acquired by oversampling with 12 bit pulse code modulation, wherein k represents the k-th sampling signal. Due to the effect of the oversampling unit, it is required to remove unnecessary signals outside the speech signal bandwidth by the use of a low-pass filter. The digital signal, $S_{nn}(k)$, through the first low-pass filter is sent into the adaptive speech analysis unit, the pitch detection unit, and the background noise suppression unit, respectively, to advance the process to the next step. In the adaptive speech analysis unit, an N'th order all-pole adaptive filter is utilized to estimate the speech signals. The coefficients of the all-pole adaptive filter is $a_i(k)$, $i=\{1,2, \ldots N\}$, which is determined to represent the unique characteristics of the speech signals, will be sent into the background noise suppression unit. Further, $S_{nn}(k)$ will be sent into the pitch detection unit to estimate the pitch periods of the speech signals, wherein the estimated pitch period P range is within 3–10 ms. If the sampling frequency is 32 KHz, then the number of samples corresponding with one pitch period is about 96–320. The pitch periods for each speech signal will be estimated and sent to the background noise suppression unit for use in the next step of suppression of the background noise.

The suppression filter unit utilizes the filter coefficient, $a_i(k)$, and the speech signal pitch period, P, estimated from the adaptive speech analysis unit and the pitch detection unit, respectively, to design the background noise suppression unit. The $S_{nn}(k)$ from the first low-pass filter is sent into the background noise suppression unit to reduce- the energy of the background noise embedded in the speech signals and enhance the speech signal-to-noise ratio. Since the high-frequency components in the original speech signals are also suppressed by the background noise suppression unit, another high-frequency booster is used to compensate for the suppression component of high frequencies in the speech signals. Finally, another low-pass filter is used to filter the noise outside the bandwidth of the speech signals. The speech signal, $\hat{S}_n(k)$, with elevated quality is thus acquired.

BRIEF DESCRIPTION OF THE DRAWINGS

The drawings disclose an illustrative embodiment of the present invention which serve to exemplify the various advantages and objects hereof, and are as follows.

REPRESENTATIVE SYMBOLS OF MAJOR PARTS

Figure 1:
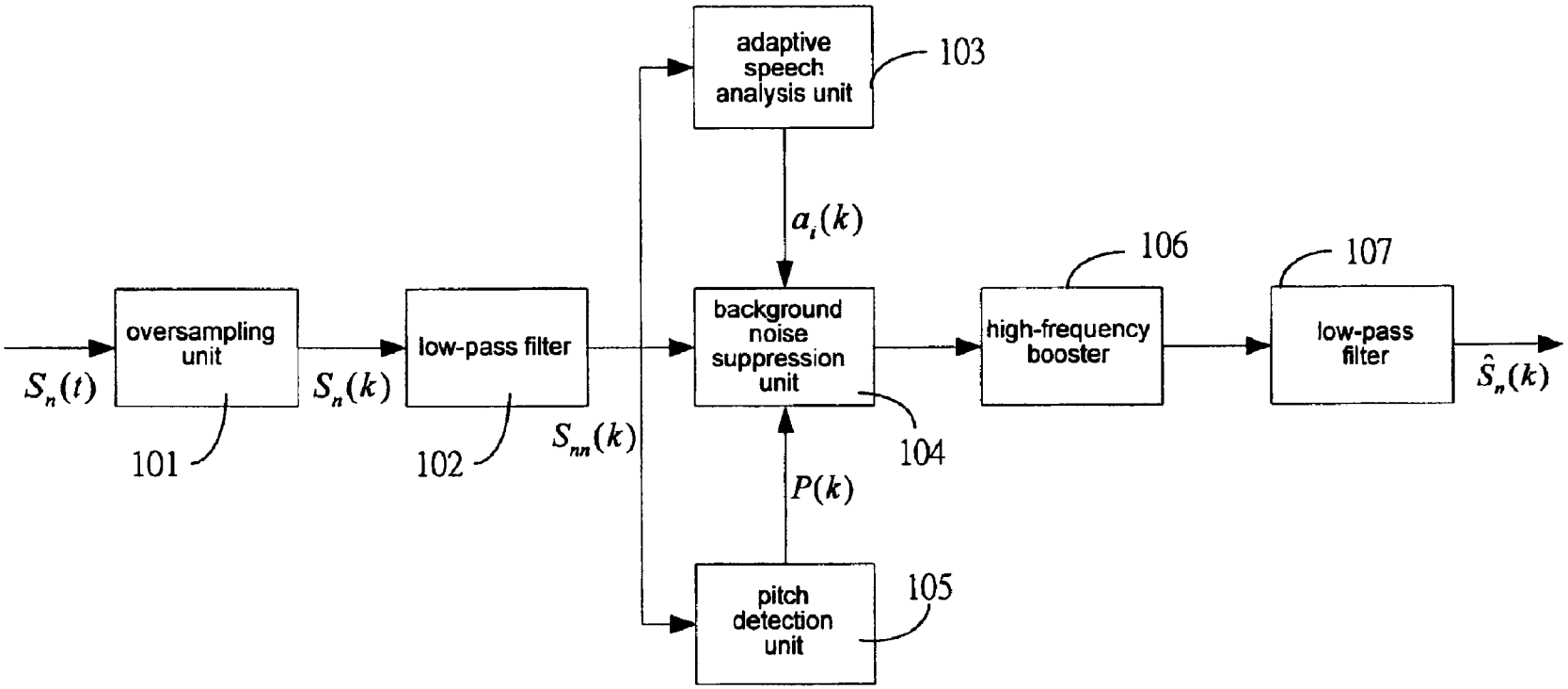
FIG. 1 is the schematic diagram of the suppression system of speech signal background noise of this invention.

101 oversampling unit
102 low-pass filter
103 adaptive speech analysis unit
104 background noise suppression unit
105 pitch detection unit
106 high-frequency booster
107 low-pass filter
21 hard limiter
221 adaptive stepsize decision unit
23 adaptive prediction filter
31 hard limiter
41 pitch decision unit
51 noise shaping filter

DETAILED DESCRIPTION OF THE PREFERRED EMBODIMENT

Please refer to FIG. 1, the suppression system of background noise of speech signals of this invention comprises: one oversampling unit 101, two low-pass filters 102, 107, one adaptive speech analysis unit 103, one pitch detection unit 105 one background noise suppression unit 104, and one high-frequency booster 106. Before proceeding with suppression of background noise, analog speech signals are transformed into digital signals which are suitable for further processing including processing through an oversampling unit and low-pass filter. The oversampling unit 101 performs analog-to-digital transformation on analog speech signals and represents the transformed digital signal with a pulse code modulation (PCM) technique. In the analog-to-digital transformation, the sampling frequency is far larger than the minimum frequency required by the sampling principle to enhance the correlation between samples. In this embodiment, the suggested sampling frequency is 32 KHz, which is 8 times the bandwidth of the general speech signal bandwidth of 4 KHz. Low-pass filter 102 is used to remove the noise outside the bandwidth of the speech signals, especially that the oversampled signals are passed through oversampling unit 101 and it is necessary to limit the bandwidth of the signal within the bandwidth of the speech signals with one low pass filter 102 to elevate the performance of the following process units. In this embodiment, it adopts one third-order Butterworth low-pass filter, wherein the cut-off frequency is designed at the bandwidth of the speech signals, which is 4 KHz. The signal $S_{nn}(k)$ from the low-pass filter is sent into the adaptive speech analysis unit 103, the pitch detection unit 105, and the high-frequency booster 106, respectively, to proceed to the next stage process.

Figure 2:
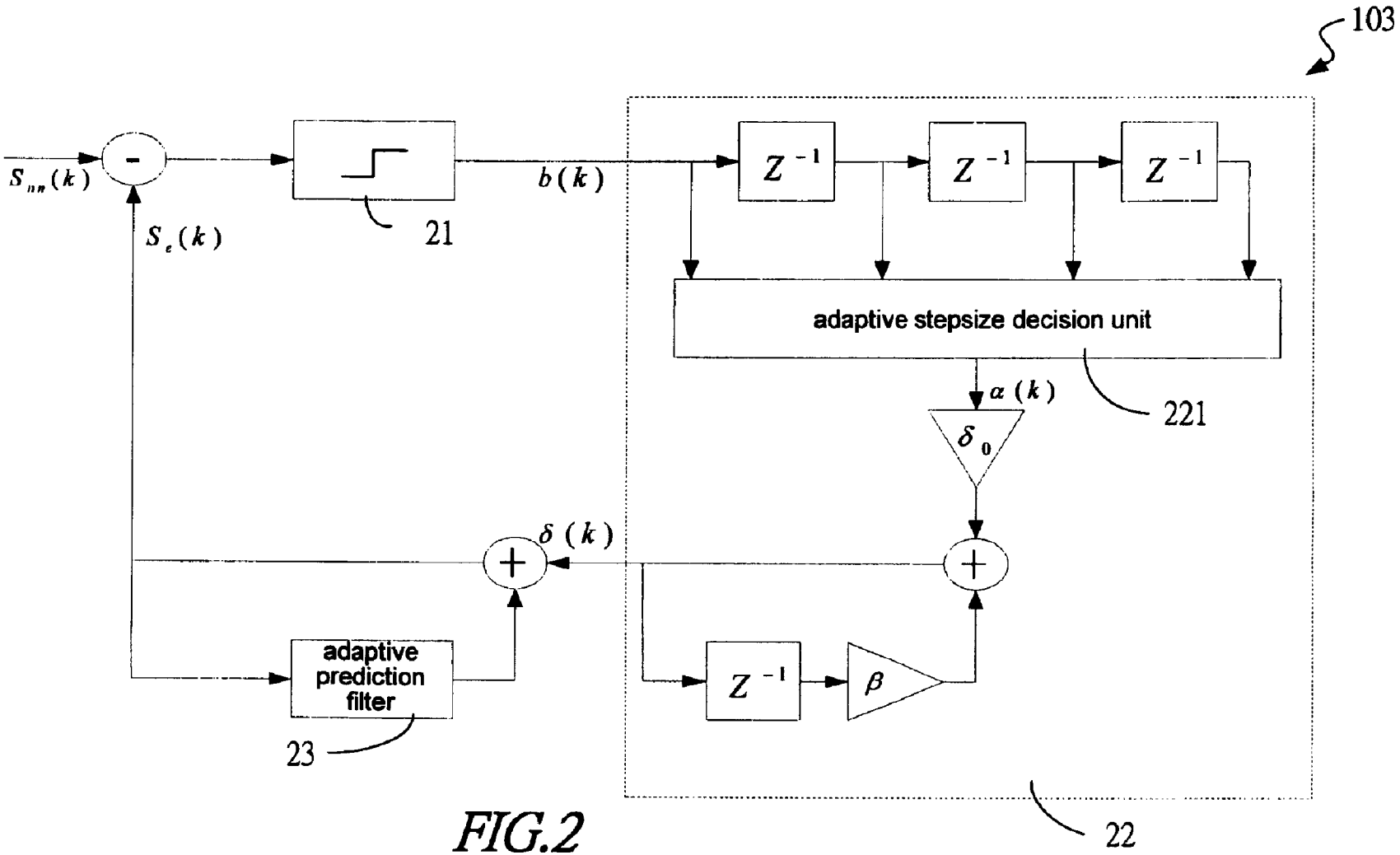
FIG. 2 is the circuit block diagram of the adaptive speech analysis unit of said suppression system of speech signal background noise.

FIG. 2 is the circuit block diagram of the adaptive speech analysis unit. The adaptive speech analysis unit 103 comprises one hard limiter 21, one stepsize estimation unit 22, and one adaptive prediction filter 23. The hard limiter 21 decides the output bit, b(k), by comparing the input speech sample, $S_{nn}(k)$, and the prediction $S_e(k)$ from the adaptive prediction filter 23, as shown in the following equation:

$$b(k) = \begin{cases} 1, \text{ if } S_{nn}(k) > S_e(k) \\ -1, \text{ if } S_{nn}(k) < S_e(k) \end{cases} \tag{1}$$

The stepsize estimation unit 22 estimates the stepsize of the current samples by utilizing the bit determined beforehand. The estimated stepsize is used to compensate for the residual signal, which is the unpredicted part of the last prediction sample. Let us assume that the currently determined bit is b(k), then the adaptive stepsize decision unit 221 in the stepsize estimation unit 22 will determine the current status of the adaptive speech analysis unit 103 according to b(k) and its preceding three bits, b(k−1), b(k−2), and b(k−3), and determine one correction coefficient, α(k), as shown in Table 1. Next, it produces one estimated stepsize, δ(k), by utilizing one first order feedback average unit at time point k as represented as follows:

$$\delta(k)=\beta^*\delta(k-1)+\delta_0{}^*\alpha(k) \tag{2}$$

wherein β<1 is the constant of the feedback average unit and is used to control the average length. $\delta_0$ is a constant and is used to adjust the value of the correction coefficient α(k) so that the adaptive speech analysis unit 103 could adapt to the variation of the speech signals. Finally, the N'th order adaptive prediction filter 23 produces the estimated value $S_e(k+1)$ for the next speech sample by combining the last N prediction samples and the estimated stepsize δ(k), as shown in the following equation:

$$S_e(k+1) = \sum_{i=0}^{N-1} a_i(k) * S_e(k-i) + \delta(k) \tag{3}$$

Table 1 is the reference table of the adaptive stepsize decision unit 221. The correction coefficient α(k) is determined according to this table. If the four consecutive bits are the same, it means that the $S_e(k)$ value estimated by the adaptive speech analysis unit 103 is not enough, so the correction coefficient α(k) is set to be 2, so that the adaptive speech analysis unit 103 could adapt to the variation of the voice sounds signals rapidly. If only three consecutive bits are the same, a smaller correction coefficient, $\alpha(k)=1$, is given to slightly increase the stepsize. If any two successive bits of these four bits are different, the correction coefficient is reset as −1. This is because at this time the adaptive speech analysis unit 103 over estimates the speech signals and the stepsize is required to be decreased. For the other conditions, $\alpha(k)=0$, which represents the status that the adaptive speech analysis unit 103 can adapt to the variation of the speech signals.

Figure 3:
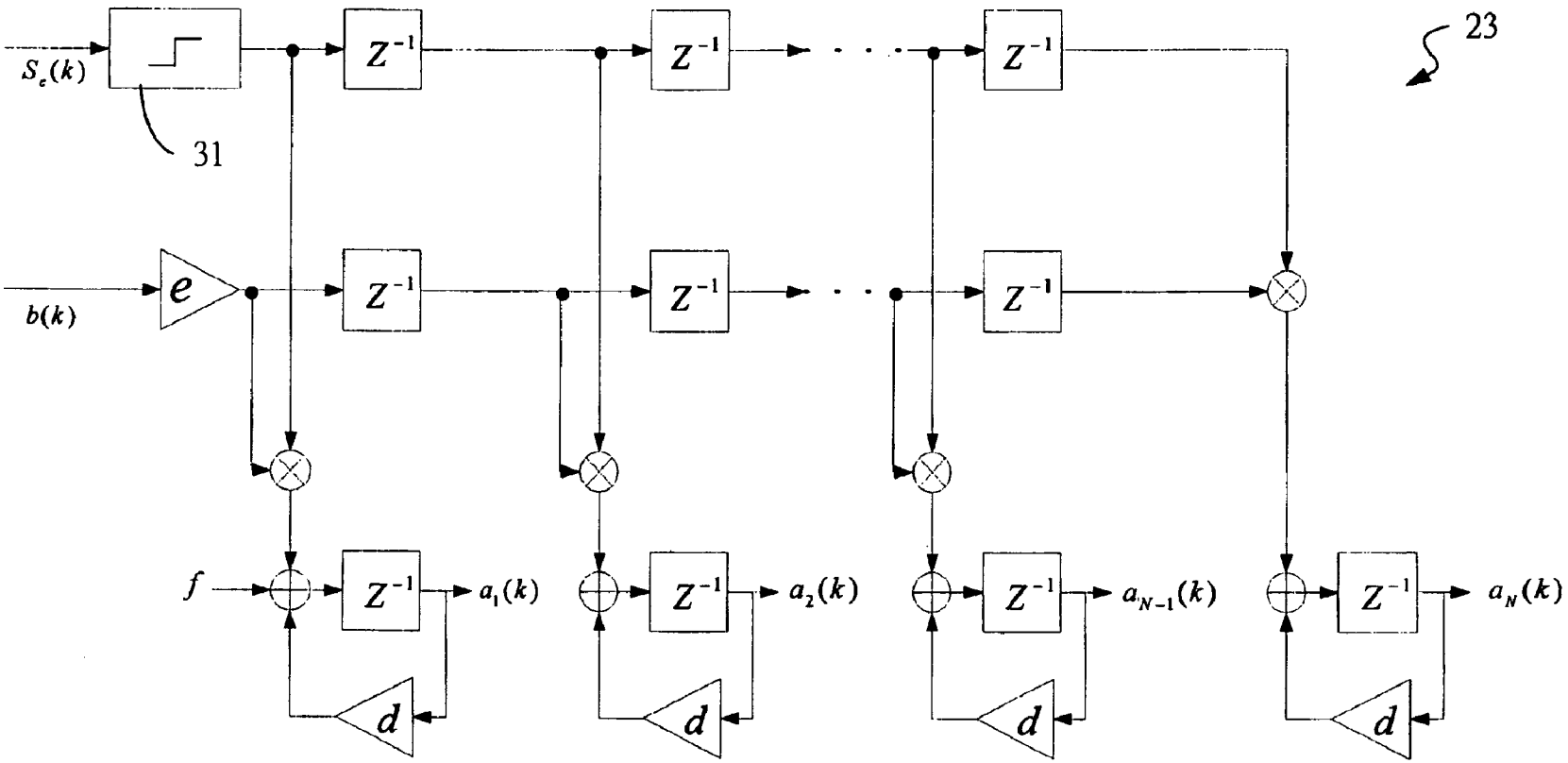
FIG. 3 is the circuit block diagram of the adaptive prediction filter coefficient of said suppression system of speech signal background noise.

FIG. 3 is the circuit block diagram of the coefficients estimation of the adaptive prediction filter 23, which is used to produce N coefficients of N'th order, $a_i(k)$, i=1,2, . . . N. The block diagram of the adaptive prediction filter 23 comprises one hard limiter 31, two rows of tapped delay lines with the length of N−1, one row of first order feedback average units with the length of N, a multiplier line of length N−1, and an amplifier. Two input signals include the speech signals estimated signal $S_e(k)$ and the digital bit b(k). First of all, the prediction $S_e(k)$ is sent into the hard limiter 31 to decide the sign of $S_e(k)$. The output of the hard limiter 31 is +1 or −1. Afterward, the last N hard-limited prediction values are stored in the delay line 1. For b(k), it is amplified with a constant gain 0<e<1 and sent into delay line 2 to store the last N amplified bits. Finally, the estimated adaptive prediction filter coefficient $a_i(k)$, i=2,3, . . . N are generated with the multiplier line and the coefficients filter bank according to the following equation:

$$a_i(k)=d*a_i(k-1)+e*b(k)*\mathrm{SGN}[S_e(k)] \tag{4}$$

wherein d is a constant which represents the average length of the first order feedback average unit. The heuristic value of d is 0.9. SGN[ ] represents the operation of the hard limiter 31. Basically, equation (4) represents a simplified stochastic gradient-based algorithm. It is noted that the generation of $a_0(k)$ is modified according to the following equation:

$$a_0(k)=d*a_0(k-1)+e*b(k)*\mathrm{SGN}[S_e(k)]+f \tag{5},$$

where f>0 is a constant and is used to emphasize the high correlation between the current speech sample and the latest one.

Figure 4:
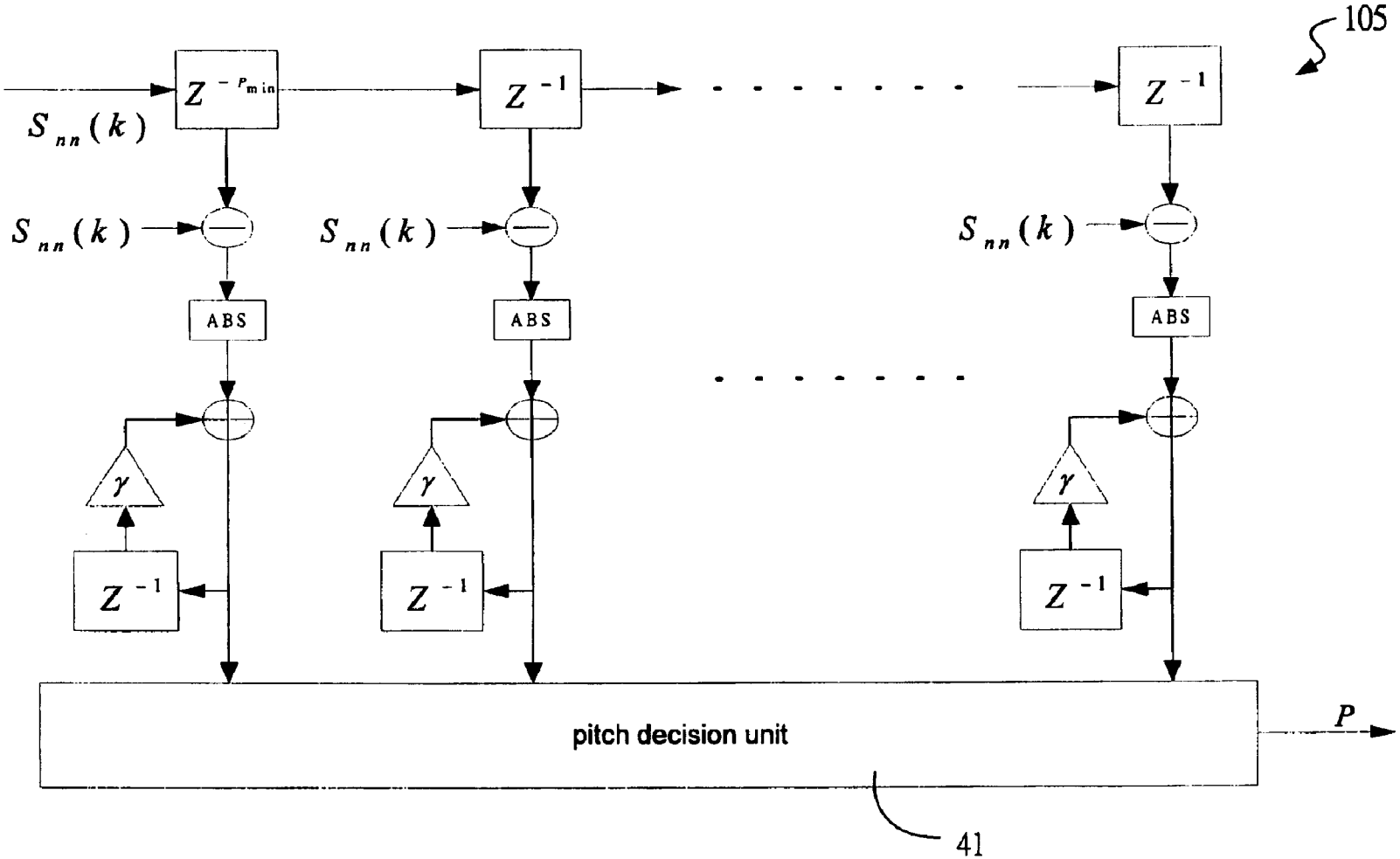
FIG. 4 is the circuit block diagram of the pitch detection unit of said suppression system of speech signal background noise.

FIG. 4 is the circuit block diagram of the pitch detection unit, which is used to estimate the pitch periods of the speech signals. The pitch detection unit 105 comprises one row of tapped delay lines with the length of $(P_{max}-P_{min}+1)$, the subtraction line with a length of $(P_{max}-P_{min}+1)$, the absolute value line with a length of $(P_{max-Pmin}+1)$, a pitch filter bank with a length of $(P_{max-Pmin}+1)$, and one pitch decision unit 41. $P_{max}$ represents the maximum possible pitch period of the voice sounds, and $P_{min}$ represents the minimum possible pitch period of the voice sounds. If the sampling frequency is 32 KHz, then $P_{max}\approx 320$, $P_{min}\approx 96$ so that the length of the tapped delay lines, subtraction line, absolute value line, and the number of first order feedback average units is 225. First of all, the input samples $S_{nn}(k)$'s are sent into the delay line to store the last $(P_{max-Pmin}+1)$ values. The $S_{nn}(k)$'s are subtracted by its delayed versions at the subtraction line. Following that, the absolute values from the subtraction line are sent into a pitch filter bank to average the correlation between $S_{nn}(k)$'s and its delayed versions. The above-mentioned operation is to search the degree of correlation between $S_{nn}(k)$ and its proceeding samples. Assume the correlation between $S_{nn}(k)$ and $S_{nn}(k-P)$ is the highest, then the smallest value of the output of the pitch filter corresponds to the Pth delay unit. Therefore, in the pitch decision unit 41, the desired pitch period P is detected according to the following equations:

$$P=\underset{P_{\min}\le i\le P_{\max}}{\arg}\{\min(E[|S_{nn}(k)-S_{nn}(k-i)|])\}, \tag{6}$$

$$\text{if } \min(E[|S_{nn}(k)-S_{nn}(k-i)|])\le E_{th}$$

$$P=0, \text{ if } \min(E[|S_{nn}(k)-S_{nn}(k-i)|])>E_{th} \tag{7}$$

wherein E[ ] represents the operation of a first-order pitch filter and $$\underset{P_{\min}\le i\le P_{\max}}{\arg}\{\min(\,|\,)\}$$

represents the selection of the parameter which makes the value within the bracket a minimum. $E_{th}$ is a threshold value of the output value of the pitch filter which is one empirical value used to distinguish between vowel and non-vowel samples. If the current sample does not belong to the vowel in the voice sounds signals, the detected P=0.

Figure 5:
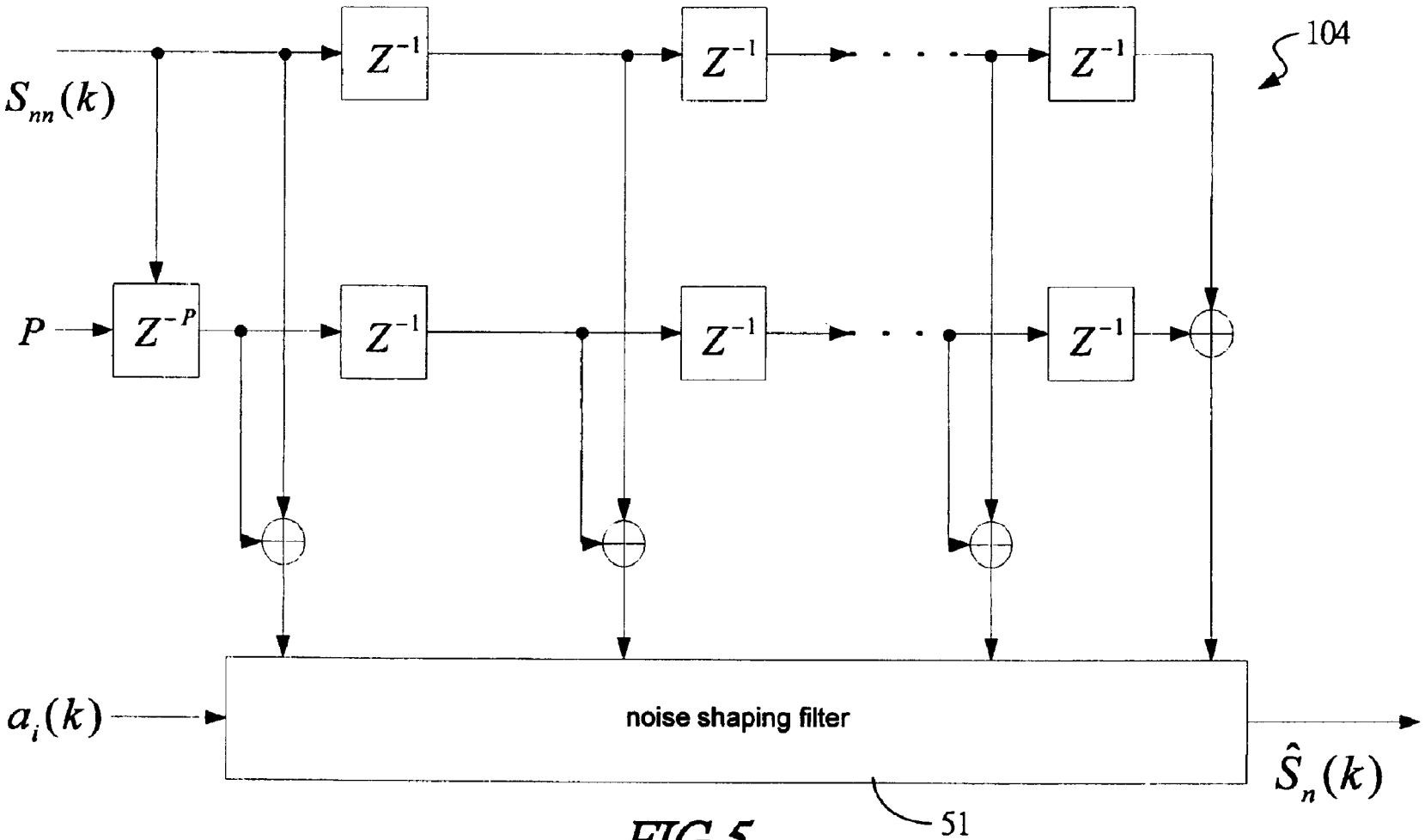
FIG. 5 is the circuit block diagram of the background noise suppression unit of said suppression system of speech signal background noise.

FIG. 5 is the circuit block diagram of the background noise suppression unit which is used to combine the speech signal characteristic coefficient $a_i(k)$ and the detected speech signal pitch period P obtained from the adaptive speech analysis unit and the speech signal pitch decision unit, respectively, to process the suppression of the background noise. The background noise suppression unit 104 comprises two rows of tapped delay lines with the length of N, one delay unit with the delay amount of P, an adder line with a length of N+1, one noise shaping filter 51. The input signals are the speech signals $S_{nn}(k)$, the speech signal characteristic coefficient $a_i(k)$, and the speech signal period P. The output is the enhanced speech sample, $\hat{S}_n(k)$. The first tapped delay line saves the previous N speech samples, which are Snn (k−1),Snn(k−2), . . . , and Snn(k−N). The second delay line also stores the last N speech samples, which is delayed beforehand for P samples according to the detected pitch period P, that is, Snn(k−P),Snn(k−P−1), . . . Snn(k−P−N). After that, these two groups of signals of Snn(k),Snn(k−1), . . . Snn(k−N) and Snn(k−P),Snn(k−P−1), Snn(k−P−N) are summed and sent into the noise shaping filter 51 along with the voice sounds speech signal characteristic coefficient $a_i(k)$. Since there is a high degree of similarity between the speech signals in these two signals, it is a harmonic addition for the speech signals, while the background noise does not have such a similarity. Therefore, it is a non-harmonic addition. Thus, the noise-suppression effect with harmonic addition can be achieved. At the noise shaping filter 51, these N+1 combined samples are filtered according to the following transfer function:

$$H(z)=\frac{1-\sum_{j=1}^{N}\beta^j a_j z^{-j}}{1-\sum_{i=1}^{N}\alpha^i a_i z^{-i}} \tag{8}$$

wherein α and β are two constants, $0\leqq\beta\leqq\alpha\leqq 1$, and are used to control the shape of the signal spectrum. Since $a_i$ represents the characteristics of the speech signals, the spectrum of the original signal will be transformed into the shape that is similar to that of the speech signals after the transformation of the noise shaping filter 51. That is, the spectra of the background noise vary with the spectra of the speech signals. This is the so-called masking effect and the benefit of suppression of the background noise thus has been achieved. Since we have performed the harmonic addition beforehand, it elevates the result of the masking effect.

Next, the speech signals, after being processed by the background noise suppression unit 104, are sent into the high-frequency booster 106.

$$H_f(z)=1-\gamma z^{-1} \tag{9}$$

Basically, this is a first order high pass filter, $0<\gamma<1$, which is used to compensate for the influence of high frequency attenuation caused by the noise shaping filter. Finally, it passes through the low pass filter, which is the same as the proceeding one, to remove the noise outside the speech bandwidth.

The suppression system of background noise of speech signals and the method thereof of this invention has the following advantages in comparison with the above-mentioned cited inventions and other traditional technologies:

1. This invention provides a suppression system of background noise of speech signals and the method thereof that utilizes one all pole linear prediction filter to re-build the model of speech signals. Also, it detects the pitch period which only exists in the speech signals. Finally, it suppresses the background noise according to the associated estimated speech signal coefficients and the pitch periods of the speech signals and further elevates the quality of the speech signals.
2. This invention provides a suppression system of background noise of voice sounds and the method thereof wherein the degree of its complexity is relatively low and it requires only one microphone, so it is very suitable to be used in mobile phone applications and the technology of speech recognition, to elevate the quality of speech coding and the recognition rate of the speech.

The above-mentioned detailed description of this invention is an explanation of one embodiment of this invention; however, said embodiment is not intended to limit the claims of this invention; all the equivalent practice or modification without departing from the spirit of this invention should be encompassed by the claims of this invention. Many changes and modifications in the above-mentioned embodiment of the invention can, of course, be carried out without departing from the scope thereof.

TABLE 1 reference table of the adaptive stepsize decision unit

| b(n) | b(n − 1) | b(n − 2) | b(n − 3) | a(n) |
|---|---|---|---|---|
| −1 | −1 | −1 | −1 | 2 |
| 1 | 1 | 1 | 1 | 2 |
| −1 | −1 | −1 | 1 | 1 |
| 1 | 1 | 1 | −1 | 1 |
| −1 | 1 | 1 | 1 | 1 |
| 1 | −1 | −1 | −1 | 1 |
| 1 | 1 | −1 | −1 | 0 |
| −1 | −1 | 1 | 1 | 0 |
| −1 | 1 | 1 | −1 | 0 |
| 1 | −1 | −1 | 1 | 0 |
| −1 | −1 | 1 | 1 | 0 |
| 1 | 1 | −1 | −1 | 0 |
| 1 | −1 | 1 | 1 | 0 |
| −1 | 1 | −1 | −1 | 0 |
| −1 | 1 | −1 | 1 | −1 |
| 1 | −1 | 1 | −1 | −1 |

What is claimed is:

1. A method for suppressing background noise in speech signals comprising the steps of:

a. sampling an analog speech signal at a frequency exceeding by a predetermined factor the Nyquist sampling criterion;

b. modulating the sampled analog speech signal in accordance with a predetermined pulse code;

c. passing the pulse code modulated signal through a low-pass filter to form a filtered digital speech signal;

d. providing the filtered digital speech signal to each of an adaptive speech analysis unit, a pitch detection unit and a background noise suppression filter unit;

e. computing an estimated digital speech signal in the adaptive speech analysis unit by the steps of:

(i) determining a correction coefficient from a predetermined number of sign bits, the sign bits being determined from a comparison of successive bits of the digital speech signal with a corresponding bit of a previously computed estimated digital speech signal;

(ii) determining a stepsize for additively updating the estimated digital speech signal, the stepsize being determined from the correction coefficient and a previously determined value of the stepsize;

(iii) computing a plurality of adaptive filter coefficients, each of the adaptive filter coefficients being computed from a sum of a previously computed adaptive filter coefficient scaled by a predetermined factor and an update value, an additive sign of the update value being determined by a sign assigned to a corresponding hard limited bit of the previously computed estimated digital speech signal, adaptive filter coefficients being sent to the background suppression filter unit; and, (iv) updating the estimated digital speech signal by scaling the previously computed estimated digital speech signal by the plurality of adaptive filter coefficients and adding the stepsize;

f. detecting pitch periods of the digital speech signal in the pitch detection unit, each pitch period corresponding to each sample bit of the digital speech signal being estimated by determining an autocorrelation of the digital speech signal for the sample bit and then selecting in a pitch decision unit a detected pitch period corresponding to the sample bit as either a pitch period that maximizes the autocorrelation or a default minimum pitch period value, the selection being made in accordance with a comparison of the maximized autocorrelation with a threshold value, each detected pitch period being sent to the background noise suppression filter unit;

g. suppressing the background noise in the background noise suppression filter unit by summing the digital speech signal with a delayed copy thereof and applying the sum to a noise shaping filter, said delayed copy being delayed by the detected pitch period, the noise shaping filter being defined by the adaptive filter coefficients;

h. utilizing a high-frequency booster to compensate for attenuated high frequency components of the digital speech signal output from the background noise suppression filter unit; and, i. utilizing a low-pass filter to remove noise outside the analog speech signal bandwidth of the digital speech signal output from the high frequency booster.

2. The method as recited in claim 1, wherein the step of detecting pitch periods includes the step of setting the default minimum pitch period value to zero.

3. The method as recited in claim 1, wherein the step of detecting pitch periods includes the step of setting the threshold value to distinguish vowel sounds from non-vowel sounds.

4. The method as recited in claim 1, wherein the step of determining a correction coefficient includes the step of retrieving the correction coefficient from a lookup table.

5. A system for suppressing background noise in speech signals by adaptively filtering the speech signals according to long time and short time statistical characteristics thereof, the system comprising:

an oversampling unit operable to transform an analog speech signal into a digital speech signal;

a first low-pass filter coupled to an output of the oversampling unit operable to remove unnecessary parts in the digital speech signal output from the oversampling unit;

an adaptive speech analysis unit coupled to an output of the first low-pass filter to analyze characteristics of the digital speech signal output from said first low-pass filter, the adaptive speech analysis unit including (a) a stepsize estimation unit to define a current estimated stepsize as a function of prior samples to compensate for a residual signal of a prior prediction sample, and (b) an adaptive prediction filter coupled to the stepsize estimation unit for receiving the current estimated stepsize and establishing a set of speech signal characteristic coefficients therewith;

a pitch detection unit coupled to an output of the first low-pass filter to estimate pitch periods of the digital speech signal output from said first low-pass filter, the pitch detection unit including (a) an autocorrelator operable to determine an autocorrelation of the digital speech signal defined by a correlation of the digital speech signal with itself as a function of delay between samples thereof, and (b) a pitch decision unit operable to select a desired pitch that maximizes the autocorrelation of the digital speech signal, the desired pitch being the estimate of the pitch period of the digital speech signal;

a background noise suppression filter having a first input coupled to an output of the first low-pass filter for receiving the filtered digital speech signal, a second input coupled to an output of the adaptive speech analysis unit for receiving the set of speech signal characteristic coefficients, and a third input coupled to an output of the pitch detection unit for receiving the estimate of the pitch period, the background noise suppression filter including (a) a correlation unit for correlating the digital speech signal in accordance with the estimate of the pitch period thereof and (b) a noise shaping filter coupled to the correlation unit and defined by the set of speech signal characteristic coefficients;

a high-frequency booster coupled to an output of the background noise suppression filter operable to compensate for attenuation of the digital speech signal caused by the background noise suppression filter; and, a second low-pass filter coupled to an output of the high-frequency booster operable to remove unnecessary parts of the digital speech signal output from the high frequency booster.

6. The system as recited in claim 5, wherein the oversampling unit is further operable to modulate the digital speech signal by a predetermined a pulse code.

7. The system as recited in claim 5, further including a bank of first-order average units in the pitch detection unit interposed between the autocorrelator and the pitch decision unit, said first-order averaging units being operable to average the autocorrelation of the digital speech signal.

8. The system as recited in claim 5, wherein the autocorrelator includes a tapped delay line, a subtraction unit coupled to each tap of the tapped delay line and an absolute value unit coupled to each subtraction unit.

9. The system as recited in claim 8, wherein the taped delay line has a predetermined number of taps based on an expected range of pitches of the digital speech signal.

10. The system as recited in claim 5, wherein the correlation unit in the background noise suppression filter includes a first tapped delay line, a second tapped delay line and a delay unit, the first tapped delay line and the delay unit being coupled at respective inputs thereof so as to receive the digital speech signal from the first low-pass filter, the second tapped delay line being coupled at an input thereof to an output of the delay unit.

11. The system as recited in claim 10, wherein the first tapped delay line and the second tapped delay line each include unit delay elements and the delay unit delays the digital speech signal by a number of samples corresponding to the estimate of the pitch period determined by the pitch detection unit.

* * * * *